United States Patent [19]

Wong et al.

[11] 4,169,267

[45] Sep. 25, 1979

[54] BROADBAND HELICAL ANTENNAS

[75] Inventors: Jimmy L. Y. Wong, Redondo Beach; Howard E. King, Gardena, both of Calif.

[73] Assignee: The United States of America as represented by the Secretary of the Air Force, Washington, D.C.

[21] Appl. No.: 916,685

[22] Filed: Jun. 19, 1978

[51] Int. Cl.[2] ..... H01Q 9/00; H01Q 1/36

[52] U.S. Cl. ..... 343/895; 343/749

[58] Field of Search ..... 343/749, 750, 895

[56] References Cited

U.S. PATENT DOCUMENTS

| | | | |
|---|---|---|---|
| 2,966,679 | 12/1960 | Harris | 343/895 |
| 3,569,979 | 3/1971 | Munk et al. | 343/895 |
| 3,683,393 | 8/1972 | Self | 343/895 |
| 3,940,772 | 2/1976 | Ben-dov | 343/895 |

OTHER PUBLICATIONS

Angelakos, D. J. et al., "Modifications on the Axial-Mode Helical Antenna," in IEEE Proceedings, Apr. 1967, pp. 558-559.

*Primary Examiner*—Alfred E. Smith
*Assistant Examiner*—Harry E. Barlow
*Attorney, Agent, or Firm*—Joseph E. Rusz; Willard R. Matthews

[57] ABSTRACT

Increased bandwidth, reduced axial ratios and improved beam shape and sidelobe characteristics are achieved with non-uniform diameter helical antennas. The antenna structures are configured to various combinations of tapered diameter and uniform sections. By varying the number of turns, diameters of the helix sections and lengths of the various helix sections, antennas are synthesized to yield specific gain-frequency response characteristics.

2 Claims, 8 Drawing Figures

FIG. 4
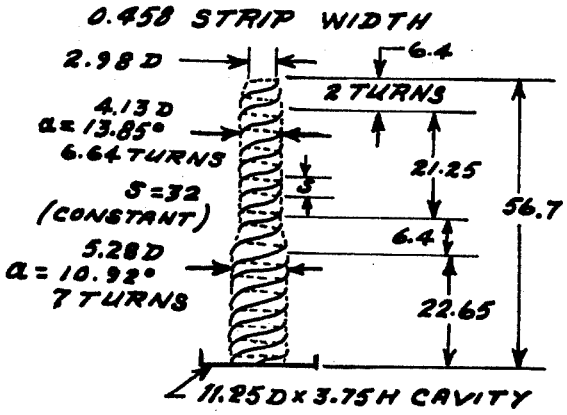
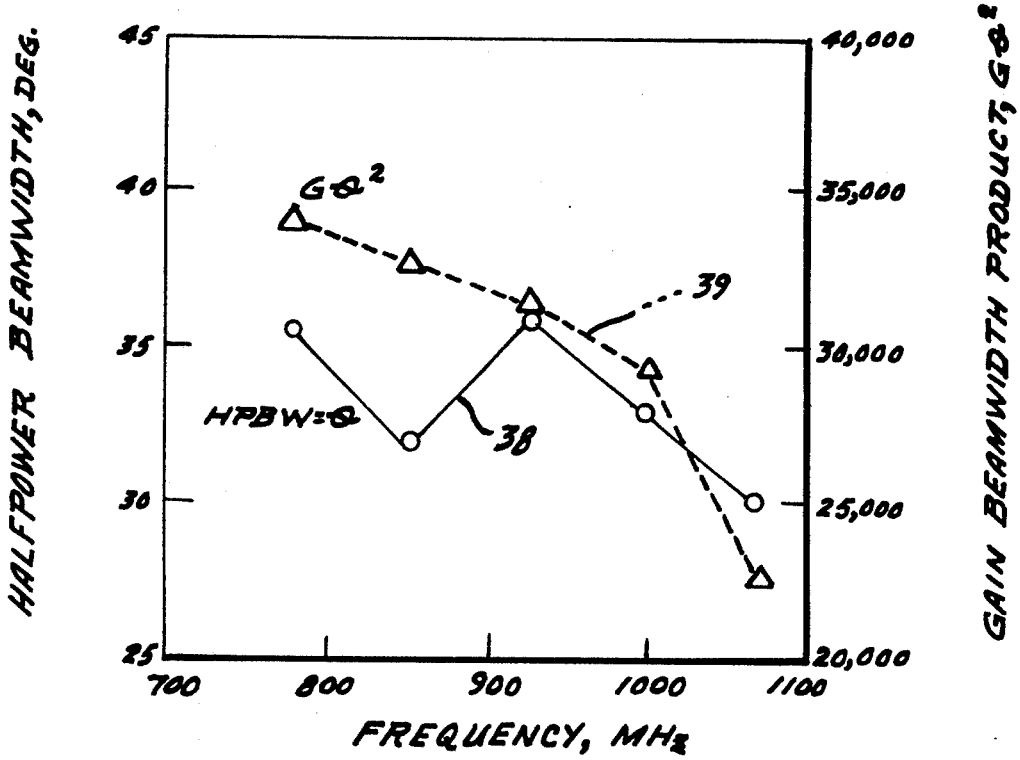
FIG. 6

BROADBAND HELICAL ANTENNAS

STATEMENT OF GOVERNMENT INTEREST

The invention described herein may be manufactured and used by or for the Government for governmental purposes without the payment of any royalty thereon.

BACKGROUND OF THE INVENTION

This invention relates to helical antennas and in particular to improvements in conventional uniform diameter and continuously tapered helix type structures.

Helical antennas are generally constructed with a uniform diameter or a tapered diameter. Although helical gain characteristics over a wide bandwidth for this type of device are not readily available in the literature, extensive testing of particular structures has demonstrated that they exhibit certain deficiencies that limit their usefulness. For example, in one particular application it was necessary to optimize the gain of a helical antenna in the lower portion of a certain band (773 to 1067 MHz) without substantial gain degradation in the upper portion of the band. It was found that a conventional uniform diameter helix was not suitable for applications requiring optimal gain over such a wide band of frequencies.

It has also been determined that uniform diameter helical antennas have large axial ratio (greater than 1 dB over the operating frequency band) and that their beam shape and sidelobe characteristics are often less than satisfactory.

Accordingly, there currently exists the need for broadband helical antennas having wide operating bandwidths, lower axial ratios and better beam shape and sidelobe characteristics than can be achieved with existing devices. It is also desirable that such antennas provide a relatively constant gain over a specified bandwidth. The present invention is directed toward satisfying these needs. The present invention further provides flexibility in the helix design to enable the antenna to meet specified gain-frequency response. With proper choice of diameters and lengths of individual helix sections the antenna can be synthesized to yield a higher (or lower) gain at the low-end of the frequency band or vice versa.

SUMMARY OF THE INVENTION

The invention is an antenna in the form of a non-uniform diameter helix structure comprised of the serially connected combination of two or more uniform diameter helical sections of different diameters and one or more tapered diameter helical transition and end sections. Particular embodiments of the invention are: a single uniform diameter helical section having a long tapered diameter end section; and, two uniform diameter helical sections of different diameters connected by a short tapered diameter helical transition section and having a short tapered diameter helical end section. A given antenna gain-frequency response characteristic can be synthesized with a non-uniform diameter helix structure by the proper choice of diameters and lengths of individual helix sections.

It is a principal object of the invention to provide a new and improved broadband helical antenna.

It is another object of the invention to provide a helical antenna having substantially larger bandwidth than currently available uniform diameter helical antennas.

It is another object of the invention to provide a broadband helical antenna having improved beam shape and sidelobe characteristics.

It is another object of the invention to provide a broadband helical antenna that can be synthesized to meet specified gain-frequency response characteristics.

It is another object of the invention to provide a broadband helical antenna having a lower axial ratio than currently available helical antennas.

These together with other objects, features and advantages of the invention will become more readily apparent from the following detailed description when taken in conjunction with the accompanying drawings.

DESCRIPTION OF THE DRAWINGS

FIG. 4 is a schematic representation of the non-uniform diameter helix of FIG. 1 indicating specific parameters;

FIG. 6 is a graph of the halfpower beamwidth and gain beamwidth product of the non-uniform diameter helix of FIG. 1;

DETAILED DESCRIPTION OF THE PREFERRED EMBODIMENT

The non-uniform helix of the invention consists of multiple uniform-diameter helical sections that are joined together by short, tapered transitions. This configuration substantially extends the bandwidth of conventional helical antennas. Furthermore, with a non-uniform helix, it is possible to shape the gain vs frequency response to provide either enhanced gain at selected frequencies or a near-flat gain response over a broad bandwidth.

Figure 1:
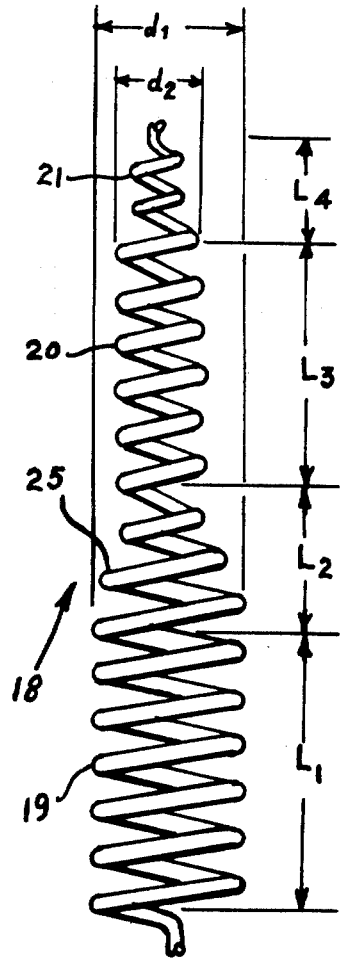
FIG. 1 illustrates one embodiment of the non-uniform diameter helix comprehended by the invention.
Figure 2:
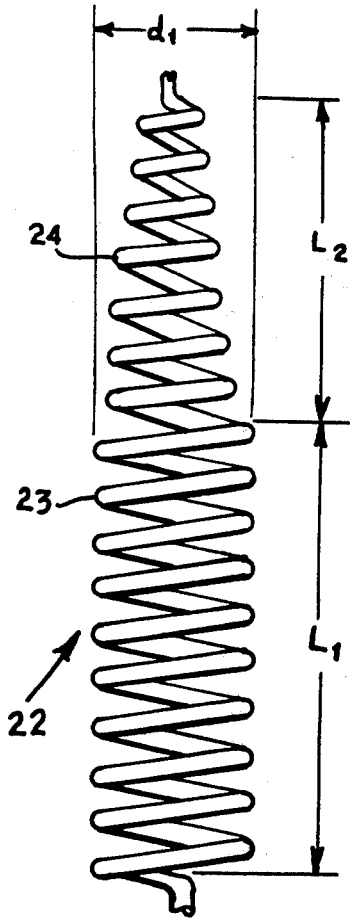
FIG. 2 illustrates another embodiment of the non-uniform diameter helix comprehended by the invention.

FIGS. 1 and 2 illustrate specific embodiments of the invention.

FIG. 1 shows an embodiment of the invention in which non-uniform diameter helical antenna 18 comprises a first uniform section 19 having a length L1 and a diameter d1, a second uniform diameter section 20 having a length L3 and diameter d2, a short tapered diameter transition section 25 having a length L2 and a tapered diameter end section 21 having a length L4.

FIG. 2 shows another embodiment of the invention in which the non-uniform diameter helical antenna 22 comprises a first uniform diameter section 23 having a diameter d1 and a length L1 and a long tapered diameter section 24 having a length L2.

By way of example curves and tests results are hereinafter presented and discussed that are based upon a non-uniform diameter helix that was developed for operation in the 290 to 400 Mhz band width optimum gain characteristics at the low frequency end. Accordingly there follows a description of the results of ⅜ scale (773 to 1067 MHz) experiments made on the various helix antenna configurations described above.

The experimental helices were wound with thin copper strips 0.468-in. wide. The plane of the strip (wide dimension of strip) was wound orthogonal to the helix axis, similar to a "slinky." Helices wound with round conductors or with metallic tapes (wound such that the plane of the tape is parallel to the helix axis) yielded similar results. The "strip" approach was chosen because of mechanical convenience and ease of construction. It was found that an accurate helix could be made by properly joining a series of loops. The mean circumference of each loop was made equal to the length of one helical turn or, equivalently, the mean diameter of each loop was made equal to $\sqrt{D_M^2+(S/\pi)^2}$, where $D_M$ is the mean diameter of the helix and S is the spacing between turns (pitch). In the tapered portions of the helix the average taper diameter of each turn was selected for $D_M$. Styrofoam forms were cut to the desired mean helix diameter and slitted with a razor blade to the desired helical path. Each loop was joined end-to-end (butt joint) and soldered together with an overlapping strap. The loops are then inserted into the slitted foam.

A constant pitch spacing of 3.2 in. was selected, although a constant angular pitch provides similar electrical characteristics as verified by experiments. The helix was backed by a cavity, 11.25-in. diameter×3.75-in. high, which is a reasonable physical size, to reduce backlobe radiation and enhances the forward gain. A metallic center tube (1.125-in. diameter), which provided mechanical support, was used in all the helix models. The total length of the helix=$NS+L_F$, where N=number of helix turns at a spacing S, and $L_F$=feed strap length (the distance above the cavity plate where the first turn of the helix starts).

Figure 3:
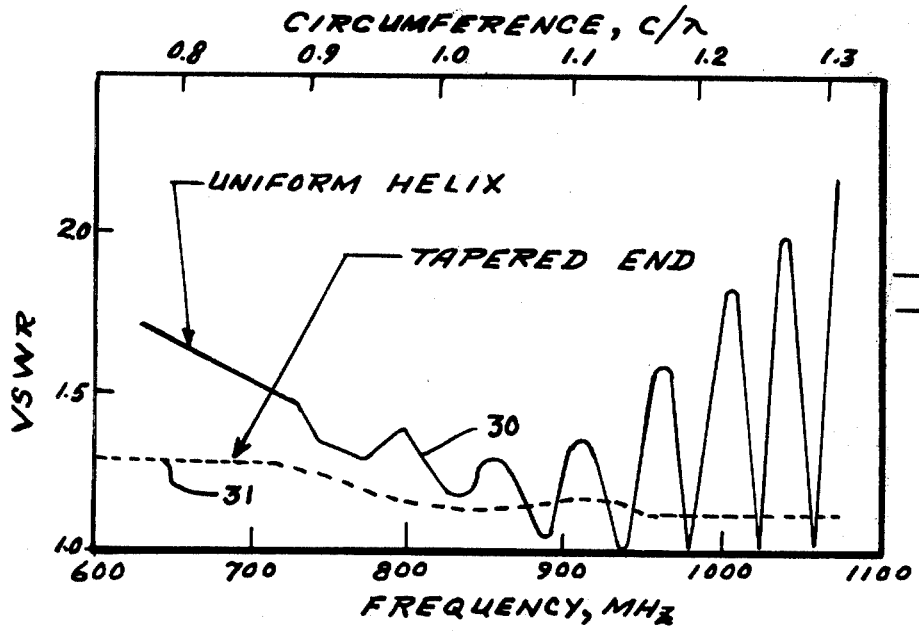
FIG. 3 is a graph of VSWR curves for the non-uniform diameter helix of FIG. 1 and a conventional uniform diameter helix.

The solid-line curve 30 of FIG. 3 is for a 18-turn uniform helix with a 4.59-in. diameter and a 12.5° pitch angle (3.2-in. spacing between turns). The dashed-line curve 31 shows a considerable improvement in VSWR and is typical for the non-uniform helices of FIGS. 1 and 2. The resonant region ($C/\lambda>1.1$) found in the uniform helix disappeared in the non-uniform helix. The VSWR characteristics for all the non-uniform helices comprehended by the invention are similar to that of curve 31 of FIG. 3.

As noted above the non-uniform helix of the invention can be made in various forms. It may be constructed with two or more uniform helix sections of different diameters or a combination of uniform and tapered sections. FIG. 1 shows a typical non-uniform helix consisting of principally two uniform-diameter sections. The particular helix herewith described is defined as a 7-turn helix (5.28 D)+2-turn taper (5.28 D to 4.13 D)+6.64-turn (4.13 D)+2-turn end taper (4.13 D to 2.98 D) and is shown schematically by FIG. 4. A constant pitch spacing of 3.2-in. was maintained in all four helical sections. During the experimental phase a parametric study was made by varying the number of turns, the diameters of the helices, and the lengths of the tapered transition region. It was found that an antenna can be synthesized to yield a specified gain-frequency response.

Figure 5:
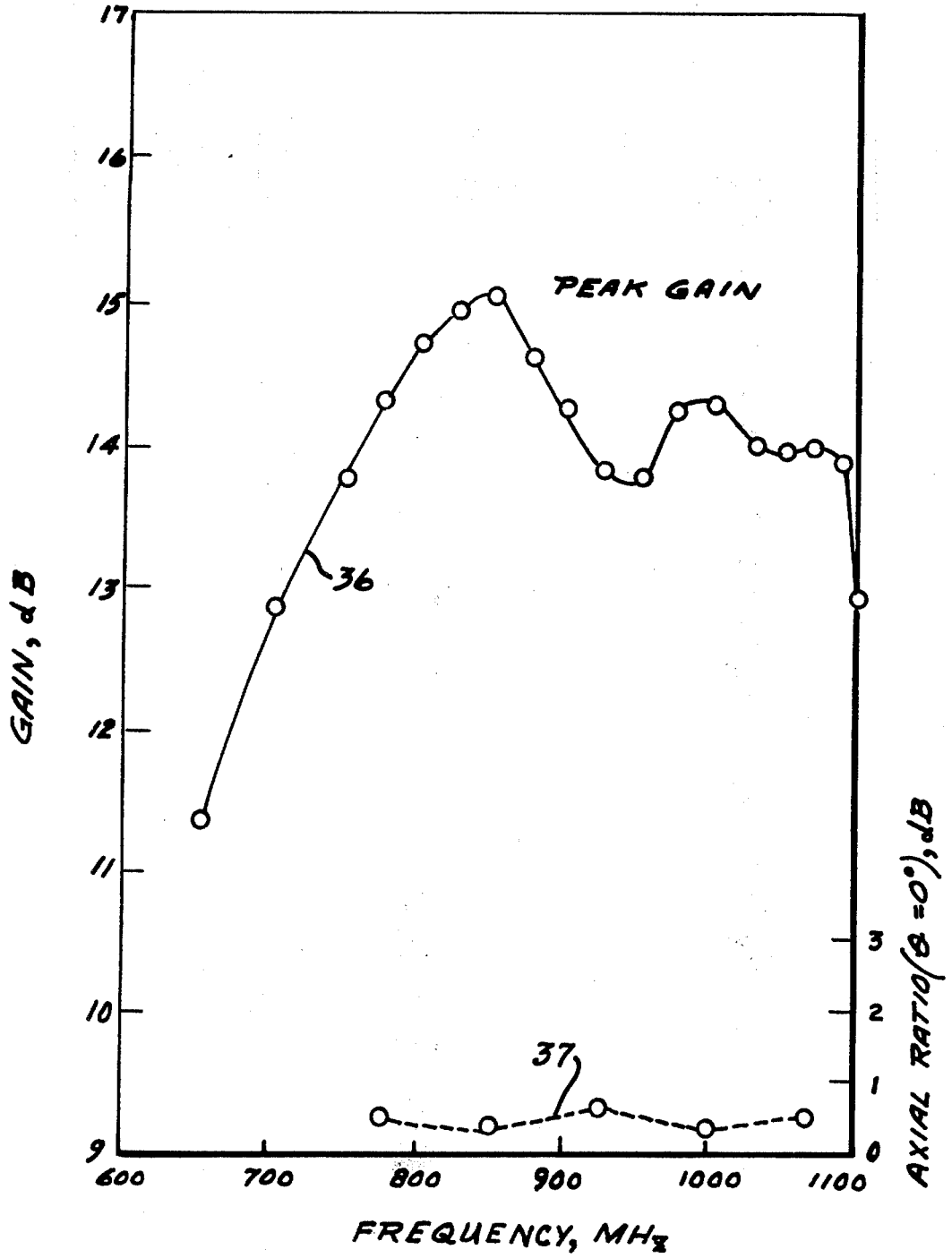
FIG. 5 is a graph of the gain and axial ratio characteristics of the non-uniform diameter helix of FIG. 1.

FIG. 5 illustrates the gain response curve 36 and axial ratio curve 37 for the non-uniform helix configuration of FIG. 4. This helix was optimized as desired over the low frequency region, with a gain of 14.7±0.4 dB from 773 to 900 MHz and 14.05±0.25 dB from 900 to 1067 MHz. The gain is constant within ±1 dB over a frequency ratio $f_{max}/f_{min}=1.55$ (710 to 1100 MHz) as compared to 1.26 for a uniform helix. The axial ratio is <1 dB. The beam shape and sidelobe characteristics are considerably improved over those of a uniform helix. It is interesting to note that the high frequency cutoff is not limited by the larger, 5.28-in. diameter helical section ($C/\lambda\approx1.55$ at 1100 MHz) but rather by the smaller, 4.13-in. diameter helical section ($C/\lambda\approx1.21$ at 1100 MHz). The HPBW curve 38 and $G\theta^2$ curve 39 are depicted in FIG. 6. Note that the beamwidth remains relatively constant, 33°±3° over the 773 to 1067 MHz test frequency range.

Figure 7:
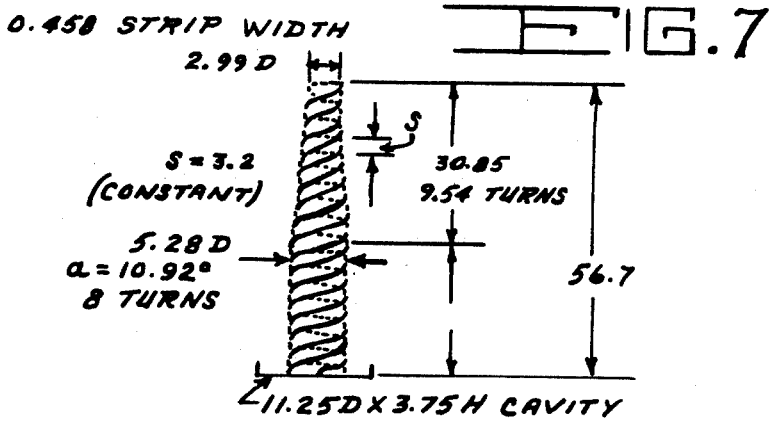
FIG. 7 is a schematic representation of the non-uniform diameter helix of FIG. 2 indicating specific parameters.
Figure 8:
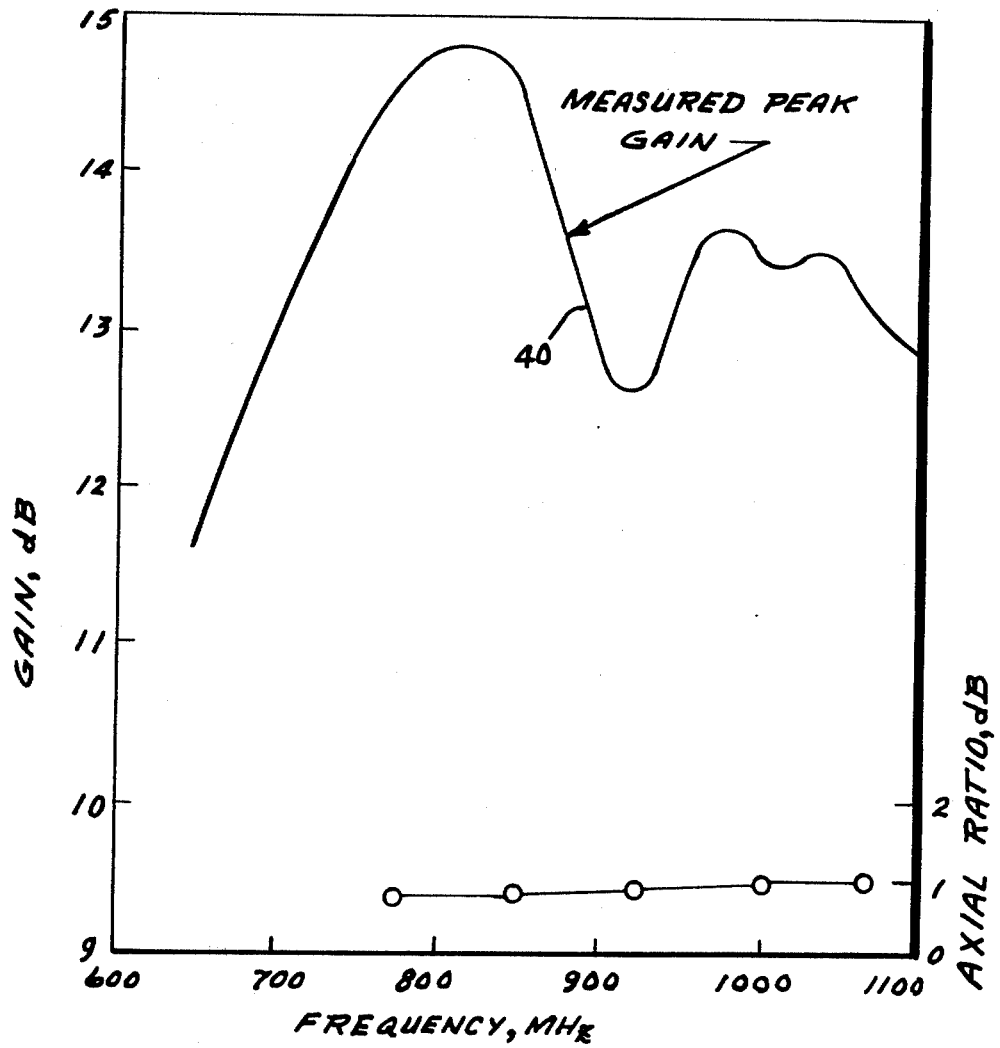
FIG. 8 is a graph of the gain and axial ratio characteristics of the non-uniform diameter helix of FIG. 2.

Another example of a non-uniform helix is shown by FIGS. 2 and 7. This helix was constructed by combining a uniform diameter and a tapered diameter helix which resulted in a helix consisting of an 8-turn uniform section (5.28-in diameter) plus a 9.64 turn tapered section from 5.28 to 2.98-in. diameter. As shown by curve 40 of FIG. 8 the ±1.1 dB gain bandwidth is wider than the non-uniform helix of FIG. 5 but the gain at the high frequency end is lower.

A more detailed comparison of the structure of the invention with conventional uniform diameter helical antennas is provided in the publication entitled *Broadband Quasi-Taper Helical Antennas* by J. L. Wong and H. E. King, U.S. Air Force Report SAMSO-TR-77-172, Sept. 30, 1977.

The uniqueness of the non-uniform helix antenna of the invention has been demonstrated by the foregoing specific examples and evaluations. Such an approach yields wider bandwidths in gain, pattern and axial ratio as compared to the conventional uniform-diameter helix. The non-uniform helix can also provide a means of synthesizing an antenna to attain a specified gain-frequency response. A continuously tapered diameter helix does not have this flexibility nor does it have the bandwidth of the non-uniform (quasi-taper) helix. The following table provides a comparison of the ±1 dB gain bandwidth for the various helical antennas as described in the above Air Force report.

| Type of Helix | Frequency Range with ± 1 dB Gain Variation | Frequency Ratio ($f_{max}/f_{min}$) |
|---|---|---|
| Uniform | 770–970 MHz | 1.26:1 |
| Tapered-End | 770–980 MHz | 1.27:1 |
| Continuous Taper | 820–1120 MHz | 1.37:1 |
| Quasi-Taper | 710–1100 MHz | 1.55:1 |

While the invention has been described in its preferred embodiments it is understood that the words which have been used are words of description rather than words of limitation and that changes within the purview of the appended claims may be made without departing from the scope and spirit of the invention in its broader aspects.

What is claimed is:

1. A broadband antenna operating in an end fire mode and having a predetermined antenna gain frequency response characteristic comprising a conductive electromagnetic wave radiating element configured to include a first uniform diameter helical section having a length L1 and a diameter D1, a section uniform diameter helical section having a length L3 and a diameter D2, a first tapered helical section having a length L2 connecting said first and second uniform diameter helical sections, a second tapered helical section having a length L4 terminating said second uniform diameter helical section, and a microwave cavity terminating the end of said first uniform diameter helical section, said helical sections having a constant pitch S and the dimensions L1, L2, L3, S, D1 and D2 being sized to effect said predetermined antenna gain frequency response characteristic.

2. A broadband antenna as defined in claim 1 operating in an approximate 773 to 1067 MHz bandwidth and having optimized gain characteristics at the low frequency end of the frequency band wherein the dimensions L1=22.65 in., L2=6.40 in., L3=21.25 in., L4=6.4 in., D1=5.28 in., D2=4.13 in., and S=3.2 in.

* * * * *